United States Patent [19]

Mounton, Jr.

[11] 4,027,854

[45] June 7, 1977

[54] SELF-EQUALIZING LINKAGE FOR WELL DERRICKS

[76] Inventor: William J. Mounton, Jr., Box 10515, New Orleans, La. 70181

[22] Filed: Oct. 15, 1975

[21] Appl. No.: 622,583

[52] U.S. Cl. ..... 254/29 R; 254/93 R

[51] Int. Cl.[2] ..... B66F 3/24

[58] Field of Search ..... 254/29 R, 93 R

[56] References Cited

UNITED STATES PATENTS

| | | | |
|---|---|---|---|
| 2,090,854 | 8/1937 | Timbs | 255/1 |
| 2,126,933 | 8/1938 | Stone | 255/1 |
| 2,240,794 | 6/1941 | Mason | 254/93 R |
| 2,683,019 | 7/1954 | Saunders et al. | 254/29 R |
| 3,096,075 | 7/1963 | Brown | 254/29 R |
| 3,282,357 | 11/1966 | Bunn | 175/122 |
| 3,413,766 | 12/1968 | Wilson | 52/115 |
| 3,871,617 | 3/1975 | Majima | 254/29 R |
| 3,877,680 | 4/1975 | Childs et al. | 254/189 R |

*Primary Examiner*—Al Lawrence Smith
*Assistant Examiner*—Robert C. Watson
*Attorney, Agent, or Firm*—Rollin D. Morse

[57] ABSTRACT

A self-equilizing mechanical leverage system for well-drilling derricks is provided for coupling pairs of hydraulic rams in side-by-side arrangement to a common load, in a manner to overcome the tendency of one ram of a pair to advance more rapidly than the other. The system is especially adapted for use with well-drilling derrick systems, for raising and lowering the drilling head and pipe string using elongated hydraulic cylinders and rams as the lifting means.

13 Claims, 4 Drawing Figures

SELF-EQUALIZING LINKAGE FOR WELL DERRICKS

FIELD OF THE INVENTION

The present invention relates to the field of well-drilling, more particularly, to improvement in derricks for the rotary drilling of deep wells, as, for example, in oil well practise. It is concerned with the newer types of oil well derricks, with which high pressure hydraulic fluid operating in cylinders equipped with sliding pistons or rams, is the means of applying power to raise or lower sections of well pipe, and indeed, the whole string of well pipe.

As is well known, earlier derricks were operated with cables that were wound or unwound from drums or winches. In the recent past, as the arts of hydraulic cylinder devices have advanced, these arts have begun to find an advantageous place in the well-drilling derrick field. Numerous examples have been seen of the use of hydraulic cylinders in parallel with one another for the raising and lowering of parts of the derrick, and/or of parts of the other mechanisms, such as the rotary swivel or drive. In most instances the cylinders (and their contained rams) have been relatively short, such that at maximum extension the ratio of length to diameter has been small enough to avoid any tendency of the combination of cylinder with its ram to buckle. In a few instances long cylinders with long rams, guide means have been provided to latch around the cylinder or ram as the extension becomes large enough to enter the unstable region; by means of such latching means buckling is prevented.

One problem incident to the use of multiple, long ram-cylinders, operating in parallel on a common load (for example in lifting a well-string of pipe, and the power swivel at the top of the string, using a single source of hydraulic fluid through a single flow-control valve), has been that small variations in the relative friction or drag between or among the parallel rams will cause the rams having higher drag to lag behind those of lower friction. Such lagging causes the cross-head means that conveys the individual cylinder power to the common load to be bent or deflected out of alignment, in turn imposing excessive loads or frictions on auxiliary parts of the system, and even causing rapid wear and scoring of sliding parts.

It has been known to provide sensing means to sense that one ram is lagging behind another, and to cause the signal produced to operate upon individual hydraulic fluid control valves to increase the fluid supply to the lagging cylinders, but these controls have been only moderately effective, and expensive to maintain.

OBJECTS OF THE INVENTION

It is a principal object of the invention to provide a self-compensating cross-head-beam leverage system whereby the lagging of one hydraulic ram of a pair causes load to be shifted to the other ram of the pair, thereby offsetting the drag or friction causing the lag, and enabling the lagging ram to "catch up" with its partner.

It is another object to avoid any necessity for external lag sensing means, control means and hydraulic fluid distributing means.

It is another object to provide automatic, immediate and proportional sensing of lag and institution of compensation, in a simple, inexpensive manner.

SUMMARY STATEMENT

In bare essence, the present invention comprises cross-head beam means centrally pivoted on a carriage that is restricted for translation along a path parallel and central to the axes of parallel hydraulic rams, the beam means bridging said rams and carrying rolling-sliding convex surfaces juxtaposed to the heads of the rams, and the beam pivot being located in the direction of ram extension beyond a line interconnecting the heads of the rams.

In preferred form, a well derrick framework erected in vertical position has a face adjacent to and parallel to the well centerline. On the face, vertical tracks provide means guiding the carriage on rollers for translational movement in a vertical direction. On the carriage there is provided a beam pivot pin, with horizontal axis intersecting the well centerline. Adjacent the face and equally spaced each side of the well centerline are the individual cylinders and rams of at least one pair of such cylinders and rams, the cylinders and rams being vertical, with the ram heads uppermost. Bridging the ram heads and pivoted on the beam pivot is a cross-head beam, which carries on its under face juxtaposed to the head of each ram, a convex surface against which the ram bears. The center of curvature of the convex surface must be located at or above the pivot point of the cross head beam. Below the pivot point, and equidistant from the well centerline, strut pivot pins are provided, to which the upper ends of tension struts are pinned. The lower ends of the tension struts are bridged with a work beam, from which are suspended short cables which in turn suspend a saddle designed to accept prior art power swivels or power slips. The saddle includes torque tubes which extend horizontally parallel to the derrick face, and to carry at their ends sets of rollers which engage tracks on the lower part of the derrick face, whereby the counter-torque of the power swivel is transferred to the derrick frame.

FIGURES

DESCRIPTION

Figure 3:
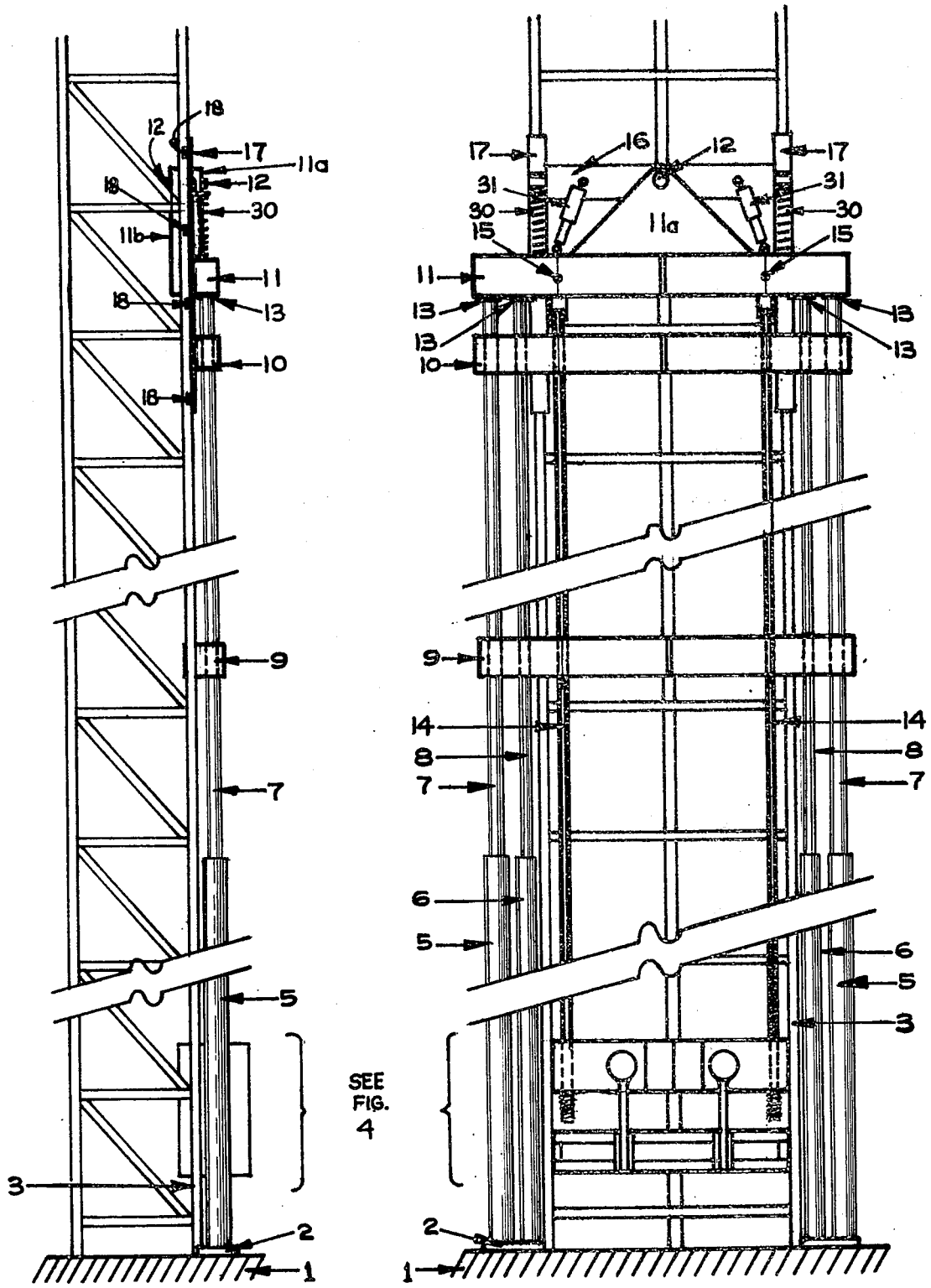
FIG. 3 shows front and side elevations of the lever system carried on a well-derrick structure.

In the drawings, FIG. 3 shows a front and side elevation of a well drilling derrick system to which the present invention is conveniently applied. As shown, a derrick has a single vertical truss 3 of generally rectangular cross section, having five legs, one at each of the four corners, and one in the center of the back (the side away from vertical centerline of the well.) These legs are interconnected by horizontal and diagonal angle-iron elements forming a conventional stiff vertical structure.

The side of the derrick toward the vertical centerline of the well is preferably set back inside the face of that side, whereby the legs on that side may more nearly bridge the vertical centerline of the well. Even more preferably the truss may be comprised of two portions, a lower fixed truss, and telescoped within it, an upper truss (not shown separately) which may be extended to any desired degree, in the initial setting up of the derrick at the well site. The bottom end of the truss is shown as mounted on a base pad 1, but it is entirely possible that it be part of an elevating, tilting and lowering system, attached to an appropriate vehicle, as is well understood in the art.

Figure 1:
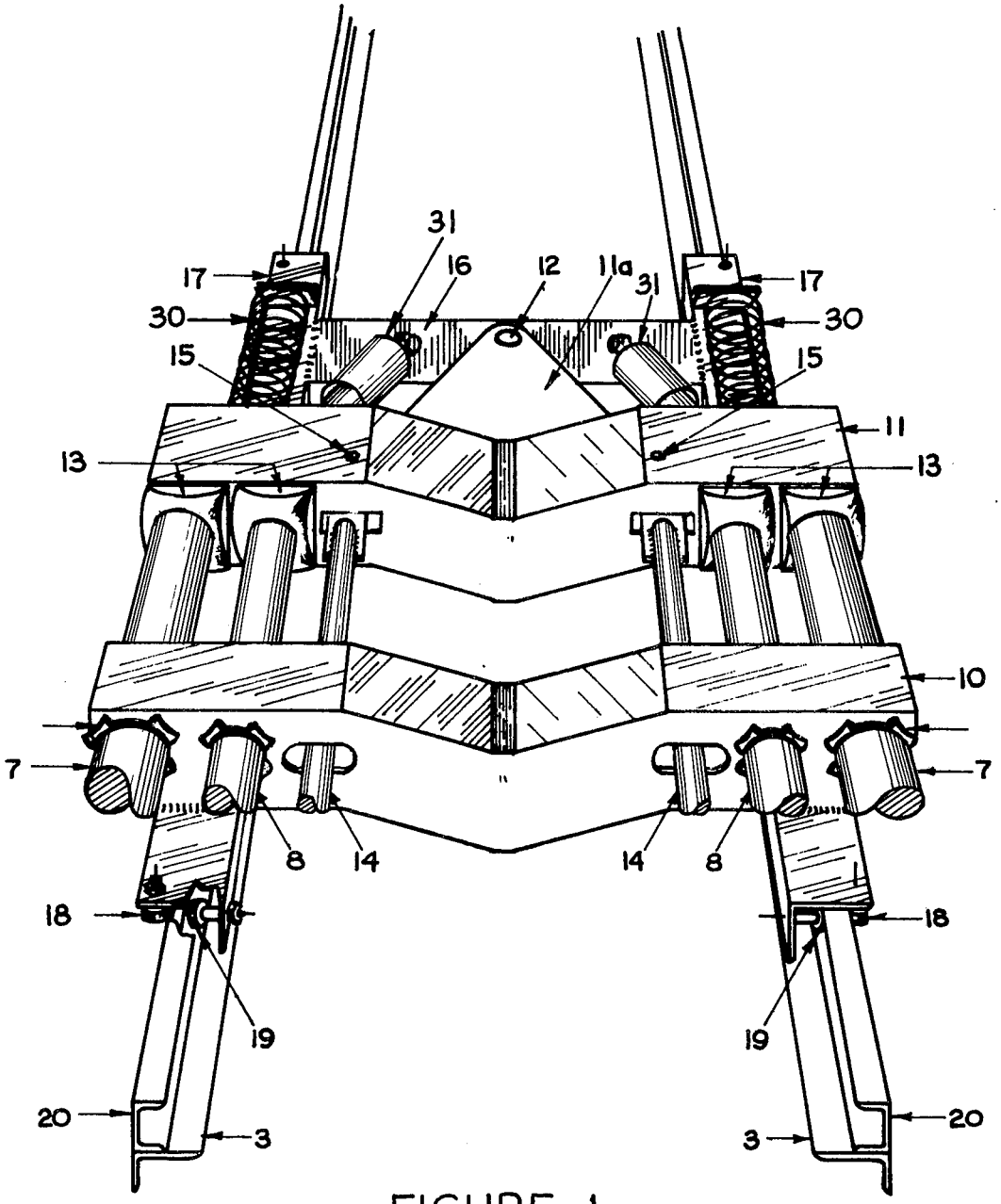
FIG. 1 shows a perspective view from below, of the lever system of this invention, with associated rams and lever-carrying trolley means.
Figure 2:
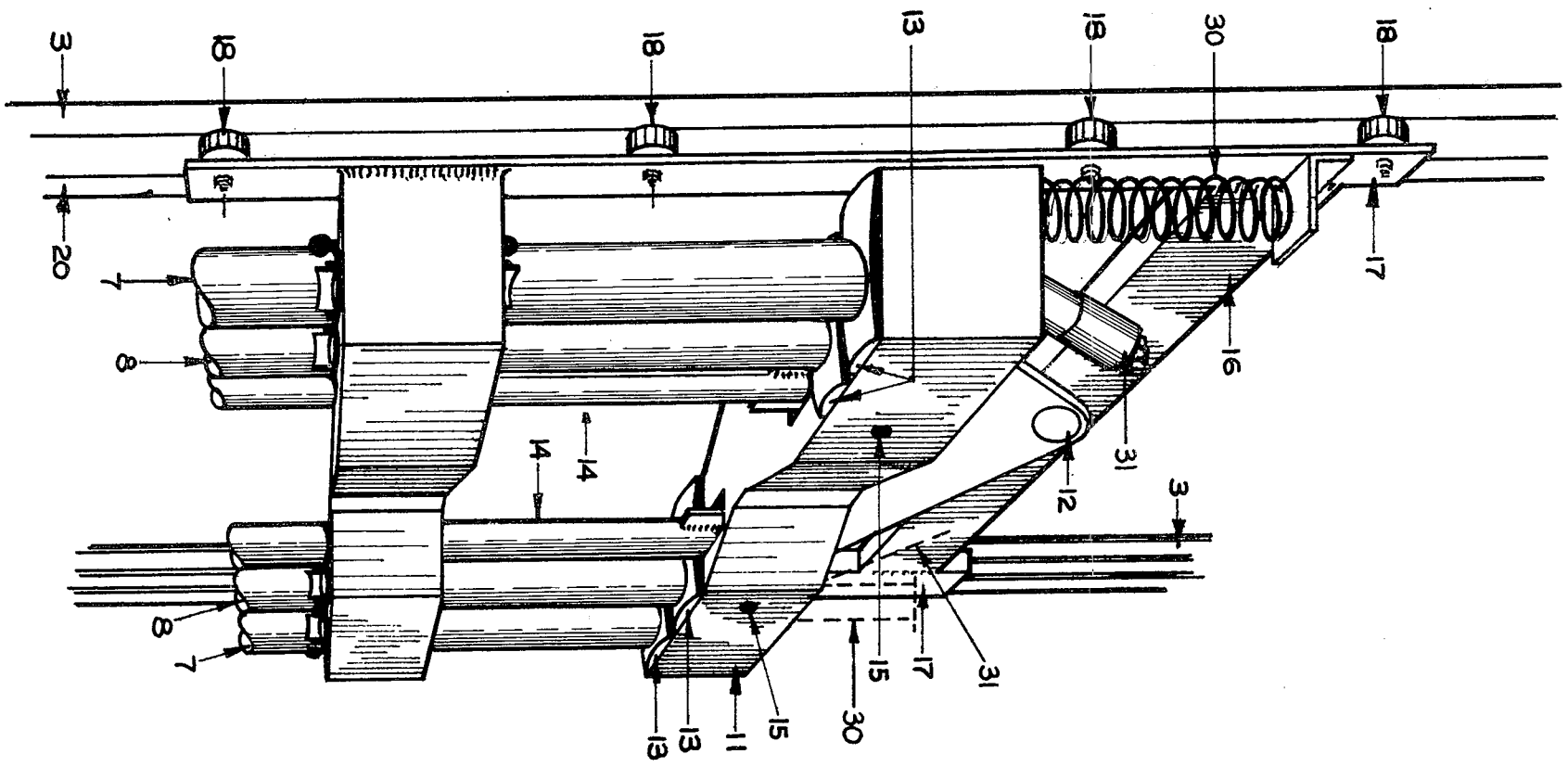
FIG. 2 shows the same lever system, from a side point of view for better understanding.

In FIGS. 1 and 2, it can be seen that the face of the truss toward the well centerline has attached to it tracks 20, which provide means for carrying and vertically moving the cross-head beam system to be described later.

Also adjacent the face of the truss are pairs of vertical hydraulic cylinders 5 and 6, mounted above bottom heads 2, and containing pairs of rams 7 and 8 respectively. The centerlines of all of the cylinders are preferably in the same plane with the well centerline, which plane is parallel to the plane of the face of the derrick truss 3. Members of a pair are equidistant from the well centerline. The cylinders may be supplied with hydraulic fluid in conventional manner through control valves and piping from a fluid reservoir and pumping system, all not shown. The Figures show two pairs of rams-in-cylinders, the pair of rams 7 and their cylinders 5 being of larger diameter than the pair of rams 8 and their cylinders 6. Flexibility of operation is obtained by this arrangement, for supply at a predetermined volumetric rate of fluid and a predetermined pressure to the small cylinder will result in a relatively fast expulsion of the rams, whereas supply at the same rate and pressure to the large cylinder with its greater displacement and its greater ram cross-sectional area, will result in a lesser speed of ram movement, but will enable the raising of a greater load.

The cylinders of each pair will be attached to the face of the derrick at several points along their length. Typically, for a 6½ inch cylinder, 42 feet long, buckling of the cylinder under load will be prevented by attachment at two or three equally spaced intermediate locations, in addition to the end attachments.

The extended portions of the rams must also be prevented from buckling under load, and the required support is provided by intermediate ram guide 9 mounted on rollers not shown for vertical motion on the tracks 20, and positioned by means not shown at the half way point of the ram extension, when the ram is fully extended. Such a means may be as simple as a pair of cables or tension struts extending downwardly from the bottom of an upper ram guide 10 shortly to be described to the lower ram guide 9, the cables having a length of ½ the ram's full extension.

DESCRIPTION OF THE CROSS-HEAD BEAM STRUCTURE

Tracks 20, mounted on the face of the derrick structure, may have many forms, the essential features being that a pin trolley framework may be freely rolled vertically, but will be prevented from movement in a horizontal plane. Conveniently, the tracks may be made from standard steel channel sections, facing one another like a pair of parentheses, and mounted vertically and parallel to one another and to the well centerline, on the face of the derrick truss 3.

A carriage called a "pin trolley means" is carried on the track 20 with rollers 18 and 19 adjacent the face of the derrick truss. The pin trolley means may be a generally flat rectangular structure having horizontal cross member 16 and vertical runners 17. Runners 17 may be pieces of standard steel angle; one web of each piece may be adjacent to the openings inside of the track 20, and may carry two or more pairs of rollers 19, so placed as to bear on the inner faces of the channels. The other web of each angle is placed parallel to the edge of the adjacent channel, and extends past the edge sufficiently far so that a second set of rollers 18, mounted on pivots on this web, will bear against the outer face of the channel.

By this arrangement of rollers the pin trolley carriage means is able to roll vertically on the tracks, but is restrained from horizontal movement. Beam pivot pin 12 mounted on member 16 has a horizontal centerline intersecting the well centerline and perpendicular to the derrick face.

Figure 4:
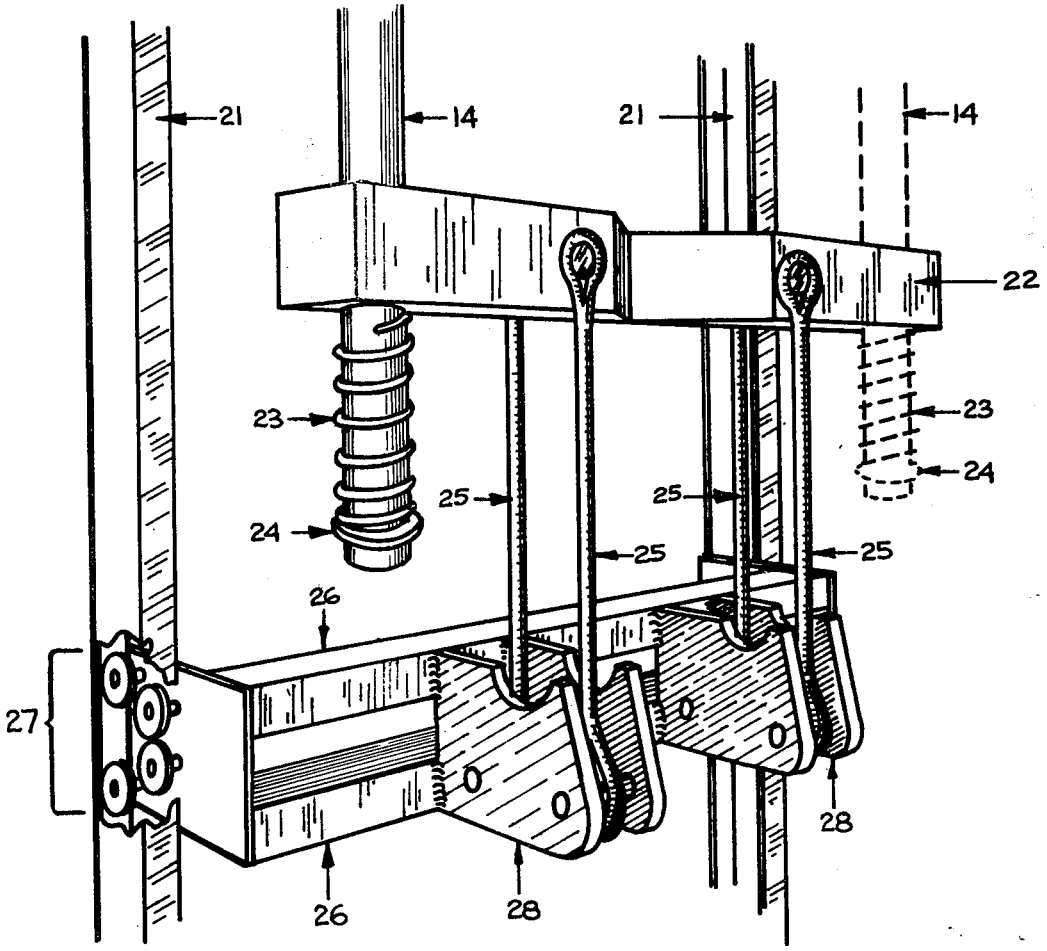
FIG. 4 shows a perspective view of the saddle structure at the base of the derrick.

Across the lower face of the pin trolley means there is rigidly attached an upper ram guide 10, the purpose of which is to hold the upper ends of rams 7 and 8 accurately aligned on their own centerlines. The ram guide 10 may be fabricated from square steel tube like a flattened M, the outer arms of the M carrying holes with rollers 35 that guide the ram ends, and a pair of elongated holes through which tension struts 14 extend downwardly. The middle part of flattened M passes behind the well pipe centerline, so that no portions of the well pipe need pass through any part of the mechanism other than the power swivel suspended in saddle 28 (FIG. 4).

The cross head beam 11 is made up similarly to the upper ram guide, with a flattened M configuration, extending outwardly over the ends of the rams. The cross head beam has pivot plates **11*a* and 11*b* as integral parts extending upward above the center of its width, and carrying pivot holes by which the beam is suspended from beam pivot pin 12. Only the front plate 11*a* is visible in FIGS. 1 and 2, with rear plate 11*b* seen in FIG. 3**.

The cross head beam 11 is free to swing below this pivot 12, in response to the forces shortly to be described. The lower face of the cross head beam carries several convex (preferably spherical) rolling-sliding bearing surfaces 13, one such surface being centered above each of the hydraulic rams 7 and 8. The centers of curvature of the convex bearing surfaces lie on or above the centerline of pivot pin 12.

The cross head beam 11 also carries two strut pivot pins 15, with centerlines parallel to that of pin 12, but in a lower horizontal plane. These pins support the upper ends of two tension struts 14, which pass downwardly through oversize holes in the ram guides and are attached as described in connection with FIG. 4 to the saddle for the power swivel. Thereby the weight of the power swivel (or slip) and any well pipe gripped in its jaws is hung by tension struts 14 below cross head beam 11.

Further to assist in overcoming any side thrusts at the region of contact of the convex faces 13 with the heads of the rams 7 and 8, it has been found desirable to introduce a slight concavity into these heads, the concavity having a radius of curvature somewhat greater than the radius of the convex surface in the contact region. The movement of the ram heads against the convex surfaces introduces a combined rolling and sliding motion, herein calld rolling-sliding. For the minimization of friction, lubrication of these surfaces is desirable, and is obtained by the use of self-lubricating materials such as porous metals impregnated with molybdenum disulfide.

Experience has shown that a considerble amount of vibration is induced in the derrick structure, and the suspension system of this invention, by the swivel and slip, by the wind, and by the various mechanical elements of the total system. To the end of minimizing the effects of such vibration, a pair of shock absorbers 31 are mounted in the space between cross head beam 11 and the cross piece 16 of the pin trolley. Further to overcome shocks a pair of large spiral springs 30 are interposed between the upper side of the cross head beam and clips attached to the upper corners of runners 17.

In FIG. 4 there is shown in detail the mechanism attached to the lower ends of the tension struts. The uppermost part is work beam 22, which, like the beams above it, is in the shape of a flattened M. The outer ends of the beam have each a hole large enough to fit loosely around tension struts 14. The work beam is held somewhat above the lower end of the tension struts, or heavy spiral springs 23 wrapped around lower ends, and retained thereon by snap washers 24, which slip into circumferential groove near the strut ends. The center of the work beam has a notch deep enough to permit a length of well pipe to stand on the well centerline within the confines of the notch.

Between the notch and the outer ends of the work beam, pins are supplied on which are hung short cables 25. The lower ends of these cables are pinned within the confines of the saddle 28, the upper edges of which are notched to accommodate the outer arms of commercial power swivels or power slips, to which the well drill pipe is attached.

The force of the power swivel in rotating the drill pipe produces an equal and opposite rotatory force on the saddles. This force is transferred by the attachment of the saddles 28 to torque tubes 26, on the ends of which are plates carrying sets of rollers 27. These rollers engage tracks 21, which are attached to the front lower corners of the derrick structure 3.

In the usual situation (not illustrated) where the upper derrick structure telescopes within the lower part, tracks 21 will not be the same as tracks 20.

OPERATION

Let it be assumed that a load consisting of a power slip and a string of well pipe held in the jaws of the slip is to be raised from the well, and that the force available from the smaller rams 8 is to be used.

Hydraulic fluid is supplied under pressure from the fluid system not shown through a single control valve to the cylinders 6 of these rams. As the rams rise out of their cylinders, they pass through the ram guides 9 and 10, and come into contact with the rolling-sliding convex bearing surfaces 13. The ram force, applied through these surfaces, raises the cross-head beam 11, and the strut pivot pins 15. The pins 15 lift the top ends of struts 14, which in turn lift the power swivel 4 and its load of well pipe.

The heart of the present invention lies in the structure and its function, for preventing uneven lifting by the rams. Small differences in the friction of the rams in their packing glands where the rams emerge from their cylinders, small mal-distributions of hydraulic fluid flow to the individual cylinders, or slight tilting of the derrick, due to wind, uneven foundation, and/or other factors which may cause one ram to rise more rapidly than its mate, are automatically overcome.

Let it be assumed that left-hand ram 8 in the figures has started to advance beyond right-hand ram 8. This advance will have raised the left hand of cross-head beam 11 correspondingly. Because the rolling-sliding bearing surface 13 has its center at or above the centerline of pin 12, and the retention of the ram end in its guide hole in upper ram guide 10, the lever arm length of the ram force about pivot pin 12 will have decreased slightly.

However, the raising of the left hand side of cross-head beam 11 will tend to raise the left hand tension strut 14 on its strut pivot pin 15. As strut pivot pin 15 rises, it is swinging outwardly to the left around beam pivot 12, and the lever arm of the left hand tension strut about pin 12 has increased. Simultaneously, the inverse happens on the right hand side, the lever arm of the right hand tension strut decreasing while the lever arm of the right hand ram increases.

The resultant effect is that the combined loads of the tension struts is shifted toward the ram which has tended to rise faster; this shift takes place until the redistribution of loads forces the rams to equalize their individual advances and thereby to stay in step.

As for practical interrelationships among the parts, analysis of ram operations indicates that an angle of about 45° between the well centerline and the line connecting the tension strut pivot 15 with the cross-head beam pivot 12, together with placement of the rolling-sliding bearing surface's center on the same level with the beam pivot pin 12, (when the cross-head beam is in its neutral horizontal position) is expected to be adequate for most non-uniformities of ram operations. Larger angles of the strut pivot 15 from the well centerline give less shift of lever arm as the cross-head beam tilts, and smaller angles, a greater shift. Higher levels of the centerpoints of the rolling-sliding bearing surfaces 13 above the beam pivot pin 12 make for a greater shift of lever arm.

ALTERNATIVES

In preferred form, the centerlines of the several cylinders and their rams, and the centerlines of the tension struts, all lie in the same vertical plane with the well centerline, since this arrangement makes for the simplest, most effective design of the apparatus; however, the principles applied in the invention are still workable if different planes are used. The rolling-sliding bearing surfaces 13 are also preferable, but other variations within the scope of the invention would include the use of complete rollers on bearings centered as described, at height equal to or above the height of the beam pivot pin.

What I claim is:

1. In a hydraulic ram system for well derricks using force-producing rams paralleled in pairs, a cross-head structure for summing and transferring the forces from the heads of the rams to common load means, the structure comprising a. a pin trolley carriage restricted for translation only along a path parallel to the axes of the rams, said carriage carrying b. a pivot pin with centerline at a right angle to the plane through the axes of the rams of a pair, and positioned between said axes, and c. a cross-head beam pivotally mounted on said pin and bridging said rams to receive their forces, d. the forces being received on rolling-sliding convex faces on the said beam from each ram, said faces being located between the heads of the rams and the pivot pin, and e. common load means attached to said structure.

2. The hydraulic ram system of claim 1, in which the rams are mounted on a framework carrying vertical tracks, the tracks being parallel to the axes of the rams, and the said carriage being provided with rolling means engaging said tracks and permitting translation of the carriage along said tracks.

3. The system of claim 2, in which the convex faces on the cross-head beam are received in concave recesses in the heads of the juxtaposed rams.

4. The system of claim 2, in which the common load means includes at least one tension strut attached at upper end to the said structure, and at its lower end to a remote load.

5. The system of claim 4, in which a pair of tension struts are arranged generally parallel to the axes of the rams, and between said axes, and are each pinned at their upper ends to each of two pinning points on the cross head beam, said pinning points being at a level lower than the pivot pin level, and equidistant therefrom..

6. The system of claim 5 in which the other ends of the said pair of tension struts are bridged by a beam attached to said other ends, said beam conveying the sum of the ram forces to the remote load means.

7. The system of claim 6, in which flexible means transfers the force from the said beam to a remote load means.

8. The system of claim 7, in which the remote load means comprises a saddle device shaped to cup and support a load.

9. The system of claim 8, in which the said saddle device includes rolling elements, and tracks are mounted on said framework parallel to the axes of the rams, adapted to couple with said rolling elements, whereby linear translation of the saddle device along said tracks is produced by operation of the rams.

10. The system of claim 3, in which the convex surfaces are spherical, each with center on the axis of its ram, and of radius at least as large as the vertical distance from the cross head beam pivot pin to a line interconnecting the heads of the rams.

11. In a well-drilling derrick system utilizing hydraulic ram means for lifting power swivels, power slips, and well-pipe string along a vertical well centerline, the derrick system having a derrick framework with a face adjacent and parallel to said well centerline, the improvement comprising in operative combination:

1. track means on said face parallelling said centerline;
2. pin trolley means riding on said track means and thereby limited to vertical translational movement, the pin trolley means carrying
3. a beam pivot pin with horizontal centerline intersecting said well centerline,
4. the said hydraulic ram means comprising at least one pair of similar hydraulic cylinders with rams, having ram heads, the ram centerlines parallelling the well centerline, the centerlines of each pair being equidistant therefrom, the cylinders being mounted for vertical movement of their rams adjacent said derrick face,
5. a cross-head beam means pivoted on said beam pivot pin, and bridging the said rams, and carrying
6. rolling-sliding convex bearing surfaces opposite each ram, the rolling-sliding centerpoint of each said surface being at a level at least equal to said beam pivot pin centerline,
7. the cross-head beam also carrying two strut pivot pins with centerlines parallel to the beam pivot pin and at a level lower than the levels of both the beam pivot pin and the said rolling-sliding centerpoints, the strut pivot pin centerlines being equidistant from the well centerline, and between the innermost pair of rams, the strut pivot pins supporting
8. two vertical tension struts extending downwardly from said strut pivot pins to
9. load means supporting said power swivel, power slip, and well-pipe string.

12. In a well derrick, a lever system for transferring forces from individuals in pairs of rising force-producing means to a common load comprising leverage-shifting means operating on at least one lever arm of the said lever system to decrease the lever arm of a first individual that rises faster than the second individual of its pair, whereby the rise is automatically opposed by increased loading of said first individual.

13. The system of claim 12 in which said force-producing means is at least one pair of hydraulic rams with ram heads normally rising in unison, and the said lever system is a cross head beam with arms carrying force-reception surfaces bridging said rams, pivoted on a horizontal pivot pin centered between the lines of force of said rams.

* * * * *

UNITED STATES PATENT AND TRADEMARK OFFICE

CERTIFICATE OF CORRECTION

PATENT NO. : 4,027,854

DATED : June 7, 1977

INVENTOR(S) : William J. Mouton, Jr.

It is certified that error appears in the above-identified patent and that said Letters Patent are hereby corrected as shown below:

Front page, under United States Patent (19):

Change " Mounton" to -Mouton-

In item (76), change "Mounton" to -Mouton-

Column 2, line 36 , after "and" delete "to".

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*